United States Patent [19]

Tholander

[11] Patent Number: 4,814,633

[45] Date of Patent: Mar. 21, 1989

[54] YARN STORING DEVICE

[76] Inventor: Lars H. G. Tholander, Fagelstigen 7, S-561 00, Huskvarna, Sweden

[21] Appl. No.: 111,786

[22] PCT Filed: Jan. 27, 1987

[86] PCT No.: PCT/EP87/00033

§ 371 Date: Sep. 17, 1987

§ 102(e) Date: Sep. 17, 1987

[87] PCT Pub. No.: WO87/04418

PCT Pub. Date: Jul. 30, 1987

[30] Foreign Application Priority Data

Jan. 27, 1986 [SE] Sweden ..... 8600360

[51] Int. Cl.[4] ..... B65H 63/032; D01H 13/16; D01G 31/00; G01N 21/89

[52] U.S. Cl. ..... 307/117; 28/187; 28/188; 57/81; 66/163; 139/273 A; 200/61.13; 200/61.18; 250/561; 340/677

[58] Field of Search ..... 19/0.25, 0.26; 28/187, 28/188; 57/81; 66/163; 139/273 R, 273 A; 200/61.13–61.18; 226/11, 45; 242/36, 49, 57, 75, 75.5, 75.51, 75.52; 340/677; 250/548, 559, 561, 562, 571, 234; 307/116, 117

[56] References Cited

U.S. PATENT DOCUMENTS

| | | | |
|---|---|---|---|
| 3,053,986 | 9/1962 | Loepfe et al. | 28/187 X |
| 3,287,887 | 11/1966 | Dornberger | 340/677 X |
| 3,298,401 | 1/1967 | Stutz | 200/61.18 X |
| 3,688,958 | 9/1972 | Rydborn | 226/11 |
| 3,752,997 | 8/1973 | MacKenzie et al. | 28/187 X |
| 3,966,132 | 6/1976 | Gelin et al. | 200/61.18 X |
| 4,023,599 | 5/1977 | Zeleny | 250/559 X |
| 4,027,232 | 5/1977 | Domig et al. | 226/11 X |
| 4,146,797 | 3/1979 | Nakagawa | 250/548 |
| 4,393,647 | 7/1983 | Kitamura | 57/81 |

FOREIGN PATENT DOCUMENTS

| | | |
|---|---|---|
| 332621196 | 12/1977 | Fed. Rep. of Germany . |
| 89005 | 4/1967 | France . |
| 2267399 | 11/1975 | France . |
| 501926 | 2/1971 | Switzerland . |
| 625484 | 9/1981 | Switzerland . |

*Primary Examiner*—J. R. Scott

*Attorney, Agent, or Firm*—Finnegan, Henderson, Farabow, Garrett & Dunner

[57] ABSTRACT

A yarn storing device (1) comprises a storage drum (2) and a sensor (5) arranged at the withdrawal end (3) of the storage drum (2). The sensor (5) has the form of an eyelet (6) for guiding the yarn (4) and generates a signal during the withdrawal of yarn (4) having a frequency corresponding to the number of turns of yarn withdrawn per time unit. For enhancing the reliability of detecting the withdrawal of yarn on the basis of the sensor signal, the eyelet (6) of the sensor (5) is movably mounted on a housing (7) of the sensor (5) and comprises a light-reflecting surface (11) wherein a light-emitting element (8) and a light-receiving element (9) are fixed to the housing (7) such that the light generated by the light-emitting element (8) falls on the light reflecting surface (11) and is directed towards the light-receiving element (9) when the eyelet (6) has a predetermined relative position with respect to the housing (7).

8 Claims, 2 Drawing Sheets

YARN STORING DEVICE

FIELD OF THE INVENTION

The present invention relates to a yarn storing device. More particularly, the present invention relates to a yarn storing device which is equipped with a sensor arranged at the withdrawal end of a storage drum of the yarn storing device, which sensor comprises an eyelet through which the yarn runs during its withdrawal from the storage drum. The yarn exerts a force on the sensor having at least a radial component directed in the radial direction of the storage drum, which force is directed in the radial plane defined by the center axis of the storage drum and the actual withdrawal point of the yarn at the withdrawal end of the storage drum. The sensor generates at least one sensor signal proportional to the detected force in a predetermined direction. When withdrawing the yarn from the storage drum it carries out a spiralling movement and, thus, exerts a force on the eyelet of the sensor which is periodically rotating so that the sensor generates an essentially periodic signal having a frequency corresponding to the number of turns of yarn withdrawn from the storage drum per time unit.

BACKGROUND OF THE INVENTION

A prior art yarn storing device of the above-mentioned kind is known from CH-C No. 62 54 84. The sensor of the yarn storing device arranged at the withdrawal end of the storage drum consists of an outer electrode in the form of a sleeve, an inner electrode and an isolating guiding body for guiding the yarn. During the running of the yarn along the isolating guiding body in its circumferential direction periodic noise signals are generated. In other words, the sliding movement of the yarn along the guiding body between the electrodes causes the generation of high frequent electric signals which are like an amplitude-modulated noise. This sensor is, due to its capacitive nature, very sensitive to any noise signals stemming from the surrounding, so that the electric signal indicating the movement of the yarn is superposed by a relatively high noise level. Hence, the detection of yarn movement by means of this sensor has turned out to be unreliable. Moreover, the signal generated by the sensor of this prior art yarn storing device depends on the particular properties of the yarn so that the necessary pre-setting of a detection circuit connected to the sensor of this prior art yarn storing device has to be adjusted when changing the type of yarn. For this reason, yarn storing devices which are commonly used in weaving machines are usually equipped with an electooptic sensor located close to the circumferential surface of the storage drum so as to detect a passing of the yarn through its detection area when withdrawing it from the drum.

Another type of yarn sensor is known from CH-C No. 44 00 73. The prior art yarn sensor described in this reference utilizes a piezoelectric detector element for detecting vibrations of a sleeve-like detector unit when the yarn is running longitudinally therethrough. When the yarn is moving through the detector element, a noise-like signal is generated by the piezoelectric element. This noise-like signal is caused by the friction of the yarn with respect to the detector element. The detector is not necessarily a piezoelectric one, but can also be an inductive detector, a magnetostrictive detector or a hall generator. These prior art sensors cannot only be used for detecting a movement of the yarn in its actual direction, but can also be used for detecting the changing motion of the running yarn at the yarn guiding drums of a spooling machine.

In view of this state of the art, the present invention is based on the object of achieving a yarn storing device of the above-mentioned kind having a more reliable detection of the withdrawal of the yarn from the storage drum.

SUMMARY OF THE INVENTION

This object is achieved by a yarn storing device in accordance with the present invention, which provides a storage drum having a withdrawal end from which yarn can be withdrawn spiralling around the withdrawal end; a yarn movement sensor arranged at the withdrawal end of the storage drum, the sensor comprising a housing containing a light-emitting element and a light-receiving element, a yarn eyelet movably mounted within the housing and light-reflecting surface on the eyelet, the light-emitting element, the light-reflecting surface and the light-receiving element being arranged so that light generated by the light-emitting element is reflected by the light-reflecting surface onto the light-receiving element and the amount of light received by the light-receiving element is periodically changed due to periodic variations of the position of the light-reflecting surface relative to the light-emitting and light-receiving elements during withdrawal of the yarn, the sensor being adapted to generate a signal during the withdrawal of the yarn which signal has a frequency corresponding to the number of turns of yarn withdrawn per unit of time.

Advantageous details of the claimed invention are defined in the respective subclaims.

BRIEF DESCRIPTION OF THE DRAWINGS

Hereinafter, a preferred embodiment in accordance with the present invention will be described in more detail with reference to the enclosed drawings, wherein.

DESCRIPTION OF THE PREFERRED EMBODIMENT

Figure 1:
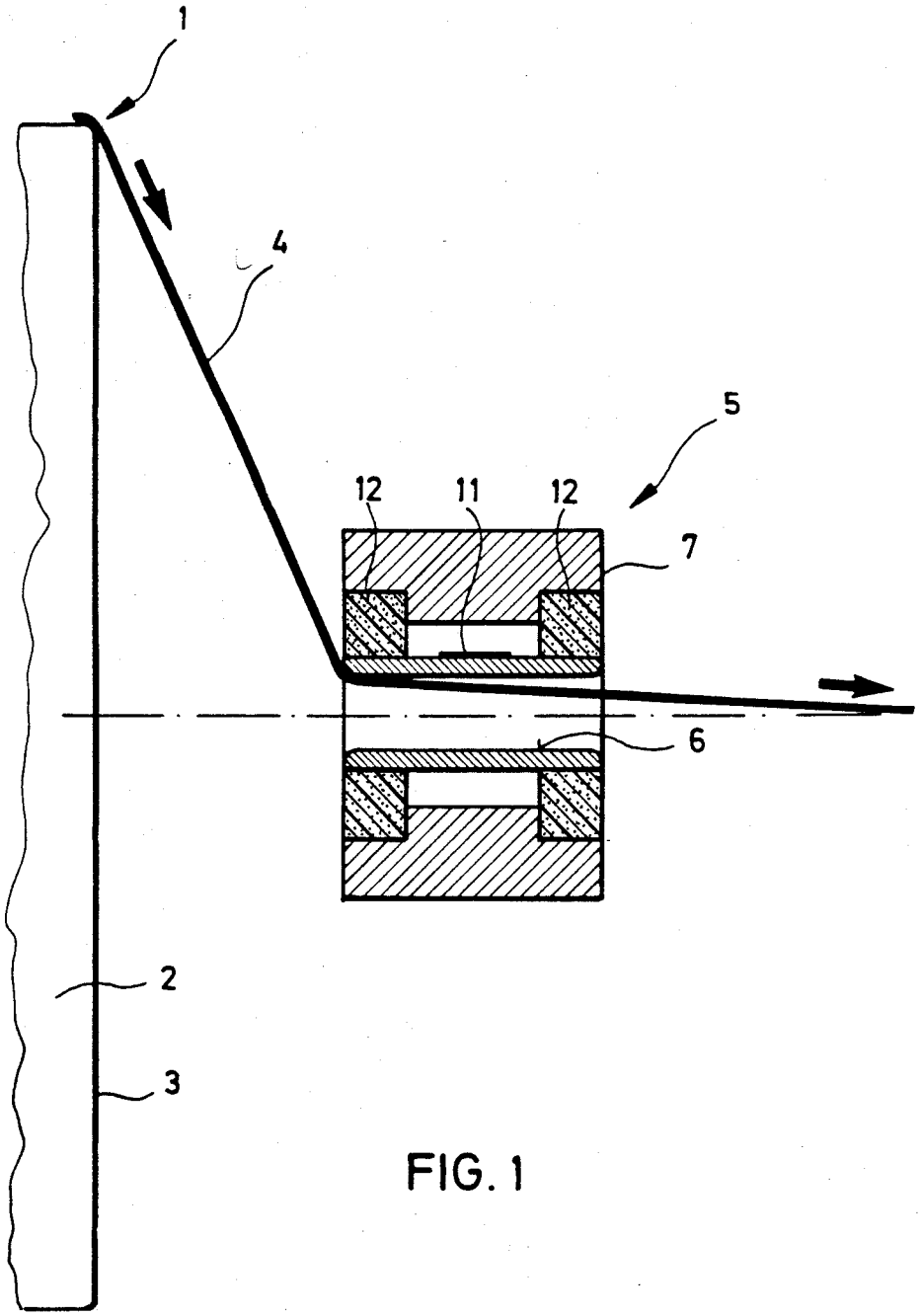
FIG. 1 shows a longitudinal cross-section of a yarn storing device and a sensor in accordance with the present invention.

The left-hand side of FIG. 1 shows a schematical representation of a yarn storage device 1 having a storage drum 2. A yarn 4 can be withdrawn from the storage drum 2 over a withdrawal end 3 thereof. The yarn withdrawn from the storage drum of the yarn storing device is fed to a textile machine, for example, a weaving machine, where the yarn is intermittently inserted into a shed of the weaving machine by weft yarn insertion means, such as mechanical grippers, projectiles, rapiers, air nozzles and the like.

The yarn storing device has a conventional design with the exception of the sensor, which will be hereinafter described.

A sensor 5 is arranged at a small, axial distance from the withdrawal end 3 of the storage drum 2. The sensor 5 comprises an eyelet 6 which is arranged concentrically with regard to the axis of the storage drum 2 of the yarn storing device 1. The yarn withdrawn from the storage drum is fed through the eyelet 6 of the sensor 5. The sensor 5 comprises a sleeve-like sensor housing 7 which is fixedly secured to the yarn storing device 1.

Figure 2:
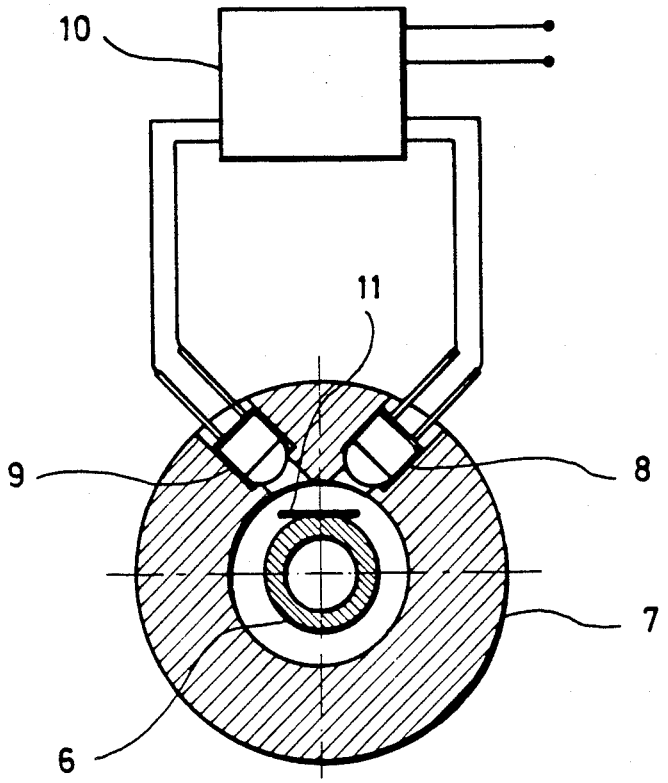
FIG. 2 shows a cross-section of the sensor as shown in FIG. 1 together with an electronic unit connected thereto.

As shown in FIG. 2, a light-emitting element 8 and a light-receiving element 9 are fitted into bores in the housing 7 of the sensor 5. The light-emitting element is preferably a light-emitting diode 8. The light-receiving element is preferably a phototransistor 9. The light-emitting element 8 and the light-receiving element 9 are connected to an electronic unit 10 for feeding a supply current to the light-emitting element 8 and for receiving a signal from the light-receiving element 9. A mirror 11 is secured to the eyelet 6 such that the light emitted from the light-emitting element 8 is reflected at the mirror 11 and directed to the light-receiving element 9.

The sleeve 6 is movably mounted within the housing 7. At the preferred embodiment, the eyelet 6 is mounted within the sleeve-like housing 7 by means of two elastic rings 12 preferably consisting of foam plastic.

Preferably, the mirror 11 is arranged such that the amount of light received by the light-receiving element has a maximum value if there is no tension in the yarn 4 so that no force is exerted on the eyelet 6. During the withdrawal of yarn 4 from the storage drum 2, the contact point where the yarn lies against the eyelet moves in a tangential direction thereof, so that the eyelet is moved on a small circular path with regard to the housing 7. Hence, the amount of light received by the light-receiving element 9 is periodically changed due to the periodical variation of the relative position of the mirror 11 with regard to the light-emitting element 8 and the light-receiving element 9. The output signal of the light-receiving element 9 is fed to the electronic unit 10 comprising a low-pass filter or a band-pass filter for removing frequency components from the output signal of the light-receiving element 9 which are caused by undesired vibrations of the sensor housing 7 due to vibrations of the surrounding equipment thereof and which do not stem from the yarn movement.

Under normal operation, the output signal 9 of the light-receiving element and the output signal of the filter circuit connected thereto can be regarded as an essentially periodic signal. When feeding this signal to the reset input of a monoflop, this monoflop remains in its reset state during the normal operation of the yarn storing device.

In case a yarn breakage occurs, the signal generated by the light-receiving element 9 is essentially constant, so that the monoflop will no longer be reset and will, thus, come in its "set" state. The output of the monoflop can, thus, be regarded as being a fault signal which can be fed to a stop-motion-relay of the yarn storing device or of the textile machine to which the yarn storing device belongs for terminating the operation thereof in case of a yarn breakage.

At the preferred embodiment as shown in the drawings, the mirror 11 has a plane light-reflecting surface. However, the mirror can also have other forms, for example, the form of a lattice, instead of having a plane form.

Moreover, the elastic rings supporting the eyelet 6 within the housing 7 can be replaced by any suitable supporting unit allowing at least a slight movement of the eyelet 6 with regard to the housing 7 when a force is exerted on the eyelet in its radial direction.

I claim:

1. A yarn storing device comprising a storage drum having a withdrawal end from which the yarn can be withdrawn spiralling around the withdrawal end, a yarn movement sensor arranged at the withdrawal end of the storage drum, said sensor having a housing containing a light-emitting element and a light-receiving element, a yarn eyelet movably mounted within the housing and a light-reflecting surface on the eyelet, the light emitting element, the light-reflecting surface and the light-receiving element being arranged so that light generated by the light-emitting element is reflected by the light-reflecting surface onto the light-receiving element and the amount of light received by the light-receiving element is periodically changed due to periodical variations of the position of the light-reflecting surface relative to the light-emitting and light-receiving elements during withdrawal of the yarn, the sensor being adapted to generate a signal during the withdrawal of the yarn which signal has a frequency corresponding to the number of turns of yarn withdrawn per time unit.

2. The yarn storing device as claimed in claim 1, wherein said reflecting surface is arranged such that the amount of light received by said light-receiving element is a maximum when no force is exerted on said eyelet by said yarn.

3. The yarn storing device as claimed in claim 1, further including an electronic unit comprising a filter for removing frequency components from an output signal of said light-receiving element which are caused by vibrations of said housing due to vibrations of equipment surrounding said housing, and wherein said electronic unit is connected to said light-receiving element.

4. The yarn storing device of claim 1, further including at least one ring of elastic material movably attaching said eyelet to said housing.

5. The yarn storing device of claim 1, wherein said light-reflecting surface is a mirror secured to the outer surface of the eyelet.

6. The yarn storing device as claimed in claim 5, wherein said mirror has a plane form.

7. The yarn storing device as claimed in claim 5, wherein said mirror surface has the form of a lattice.

8. The yarn storing device as claimed in claim 1, wherein said housing of said sensor has a sleeve-like form.

* * * * *